United States Patent [19]

Miller

[11] Patent Number: 4,587,684

[45] Date of Patent: May 13, 1986

[54] PRECAST CONCRETE BRIDGE

[75] Inventor: George R. Miller, Boyertown, Pa.

[73] Assignee: Roman Arch and Culvert Corporation of America, Birdsboro, Pa.

[21] Appl. No.: 541,925

[22] Filed: Oct. 14, 1983

[51] Int. Cl.[4] ..... E01D 7/00; E01D 19/00; E01D 19/06; E01D 19/12

[52] U.S. Cl. ..... 14/24; 14/15; 14/16.1; 14/73; 52/87; 52/227

[58] Field of Search ..... 14/24–26, 14/2, 15, 16.1, 73; 52/87, 227, 228; 405/286

[56] References Cited

U.S. PATENT DOCUMENTS

| | | | |
|---|---|---|---|
| 237,471 | 2/1881 | Bissell | 52/87 |
| 597,281 | 1/1898 | Geisel | 14/26 X |
| 890,769 | 6/1908 | Hewett | 52/227 X |
| 1,278,364 | 9/1918 | Luten | 405/286 X |
| 2,921,354 | 1/1960 | Pankey et al. | 52/227 X |
| 3,145,502 | 8/1964 | Rubenstein | 52/228 X |
| 3,478,481 | 11/1969 | Heirli et al. | 52/432 |
| 3,482,406 | 12/1969 | Schuppisser et al. | 61/16 |
| 3,559,361 | 2/1971 | Sarros | 52/227 X |
| 3,788,023 | 1/1974 | Macchi | 52/227 X |
| 3,802,205 | 4/1974 | Dickinson | 405/286 X |
| 4,314,775 | 2/1982 | Johnson | 405/155 |
| 4,332,118 | 6/1982 | Westberg | 14/16.1 X |

FOREIGN PATENT DOCUMENTS

| | | | |
|---|---|---|---|
| 1286805 | 1/1962 | France | 14/24 |
| 1524285 | 4/1968 | France | 52/227 |
| 163638 | 12/1964 | U.S.S.R. | 14/24 |

*Primary Examiner*—Stephen J. Novosad

*Attorney, Agent, or Firm*—Seidel, Gonda, Goldhammer & Abbott

[57] ABSTRACT

A bridge is made from a plurality of precast arcuate spans of reinforced concrete disposed side by side between concrete facia. The facia project upwardly to an elevation above the crown of the spans. Elongated rods join the spans to each other and to the facia.

12 Claims, 7 Drawing Figures

FIG. 1
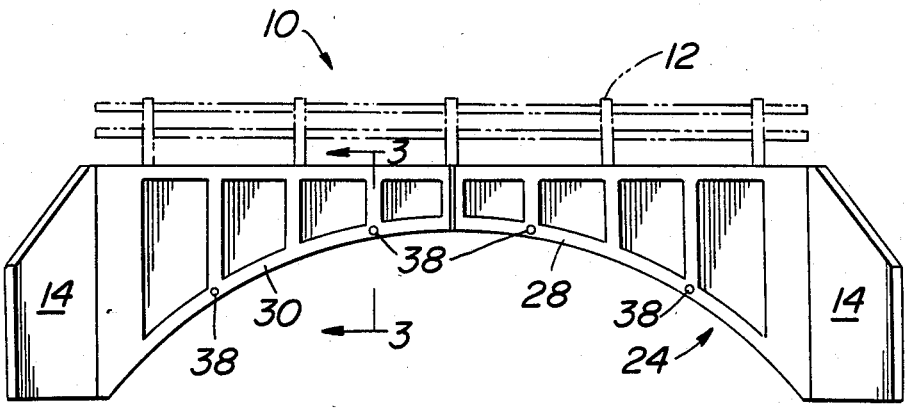
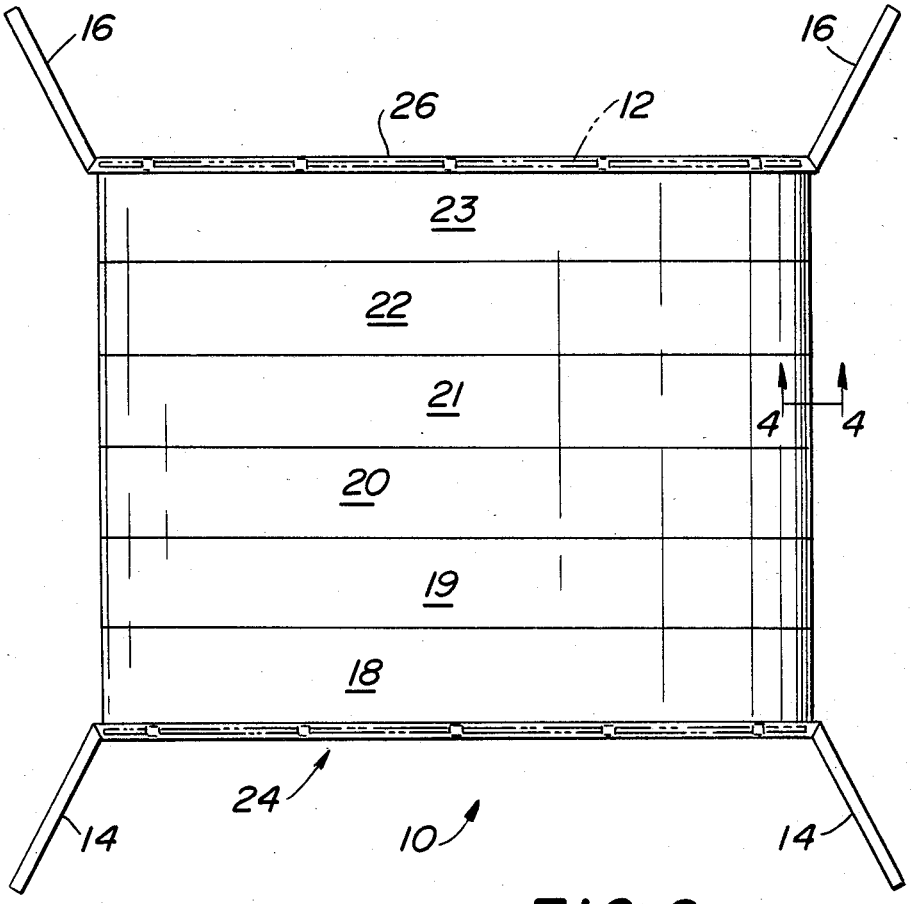
FIG. 2

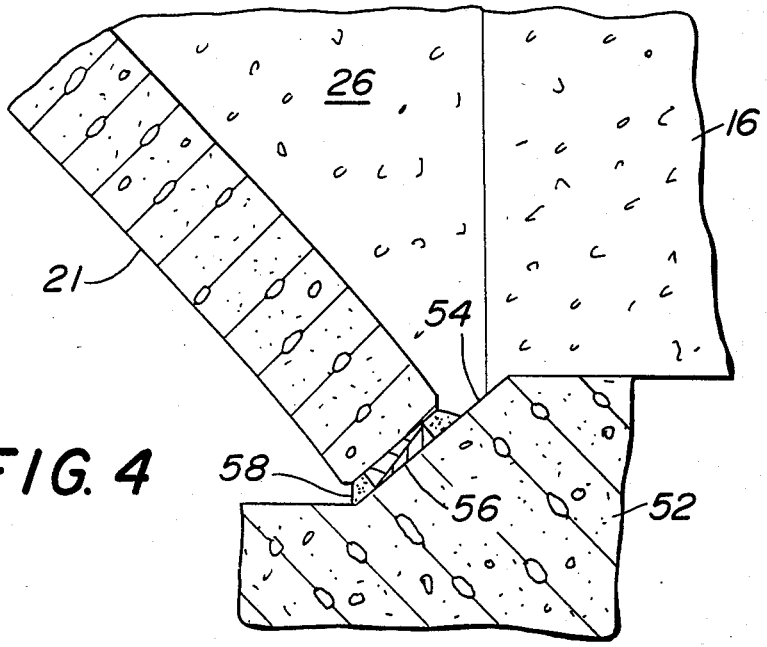
FIG. 4
FIG. 5
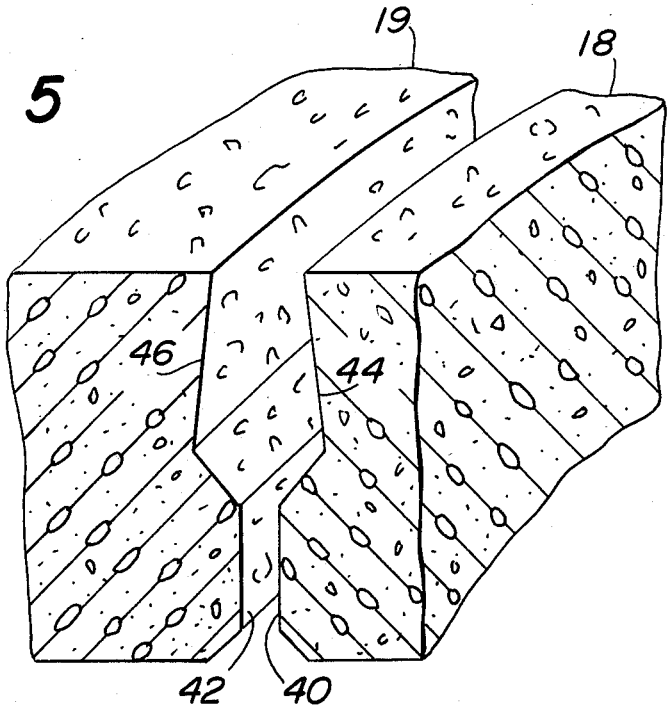

FIG. 6
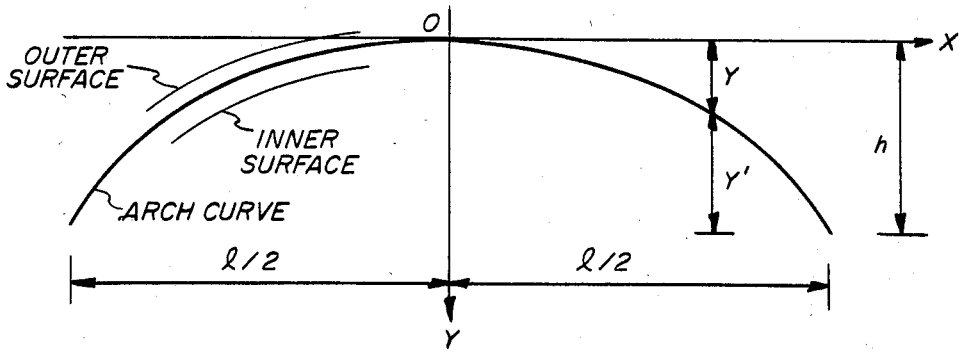
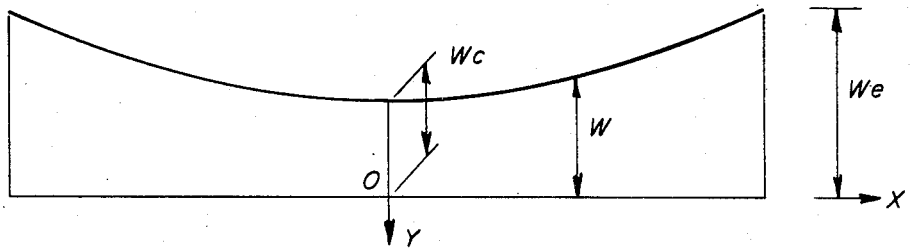
FIG. 7

PRECAST CONCRETE BRIDGE

BACKGROUND OF THE INVENTION

Precast reinforced concrete bridges are per se known. For example, see US. Pat. No. 3,482,406. The bridge disclosed in said patent is more theoretical than practical in that few details are given as to how the spans are connected to each other. Further, the precast spans are provided with an arch shape which is non-circular at least in part.

It is known from U.S. Pat. No. 3,478,481 to connect adjacent spans of reinforced concrete by welding the metal reinforcement together. It is known to make tunnels of precast concrete by precasting the tunnel into halfs which are then joined together.

There is a need for a simple and inexpensive design of a precast bridge whereby the components may be delivered by a truck to the site and erected in one day with minimal skilled labor.

SUMMARY OF THE INVENTION

The present invention is directed to a bridge having a plurality of precast arcuate spans of reinforced concrete which can be disposed side by side between concrete facia. The facia projects upwardly to an elevation above the crown of the spans. Elongated rods join the spans to each other and to the facia.

Various objects and advantages of the present invention will appear hereinafter.

For the purpose of illustrating the invention, there is shown in the drawings a form which is presently preferred; it being understood, however, that this invention is not limited to the precise arrangements and instrumentalities shown.

FIG. 1 is a side elevation view of a bridge in accordance with the present invention.

FIG. 2 is a top plan view of the bridge shown in FIG. 1.

FIG. 4 is a sectional view taken along the line 4—4 in FIG. 2.

FIG. 5 is an enlarged sectional view of juxtaposed surfaces on adjacent spans.

FIG. 6 is an illustration of arch geometry.

FIG. 7 is an illustration of a load curve.

DETAILED DESCRIPTION

Figure 3:
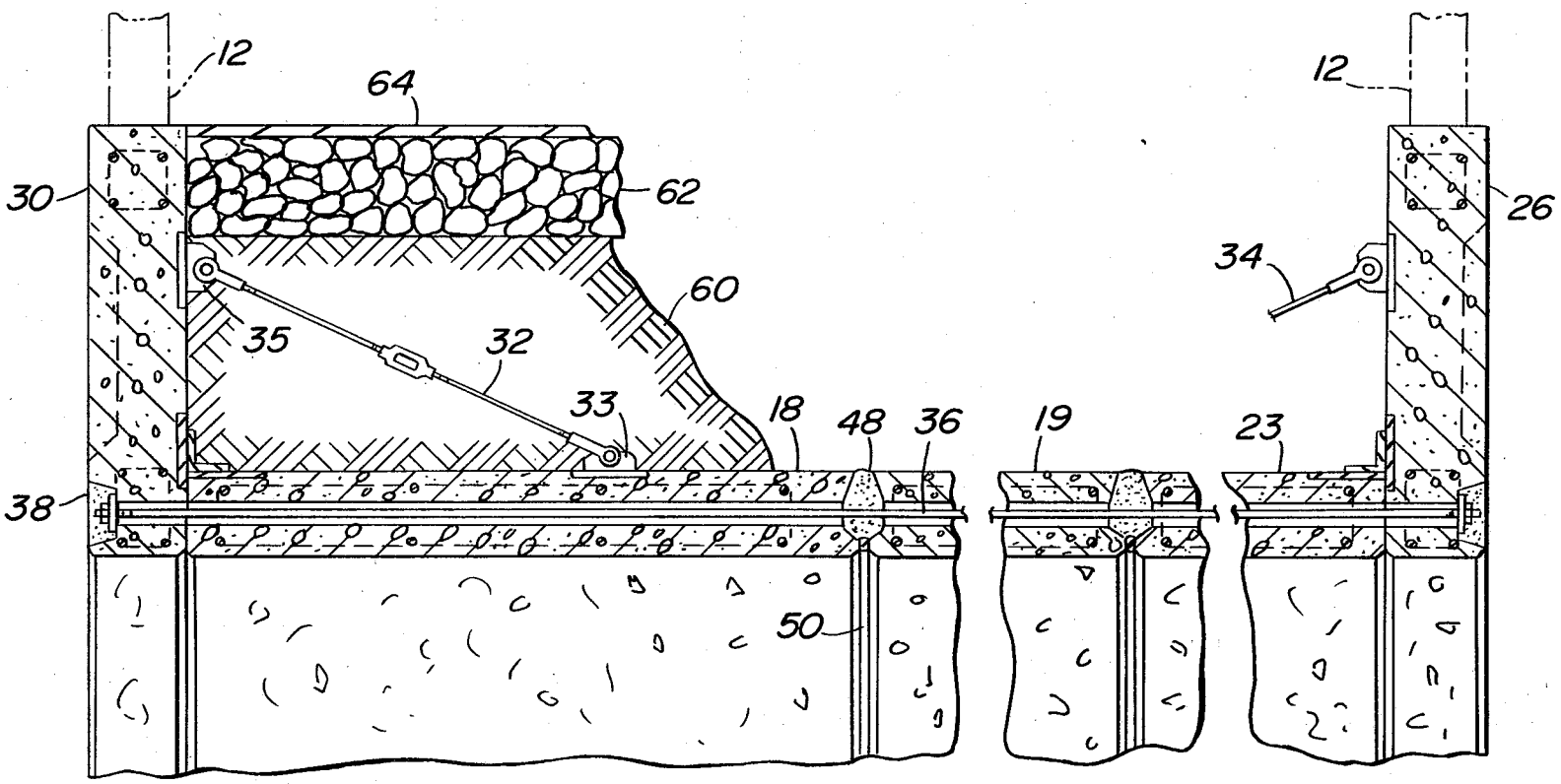
FIG. 3 is a sectional view taken along the line 3—3 in FIG. 1.

Referring to the drawing in detail, where like numerals indicate like elements, there is shown in FIG. 1 a bridge designated generally as 10 for spanning a brook, culvert, etc. Bridge 10 may have a fence 12 projecting upwardly thereform and may have wings 14 on one side and matching wings 16 on the other side. The wings and fence are optional.

The bridge 10 is comprised of a plurality of reinforced concrete spans disposed side by side and of uniform thickness. Spans 18–23 are illustrated in FIG. 2. The number of spans is optional depending on the desired width of the bridge.

Facia 24 and 26 are provided on opposite sides of the bridge 10. Each facia is preferably precast as two separate pieces or sections. The sections of facia 24 are designated 28 and 30 and meet at the crown. The bottom surface of the facia 24 is arcuate and parallel to or coextensive with the bottom surface of the spans 18–23. Hence, in side elevation the spans are not visable as will be apparent from FIG. 1. The facia may have any desired design precast onto its exposed surface. Each of the spans and the facia are precast concrete reinforced with metal rebars or other metal rods.

Each section of each of the facia is attached to its adjacent span by a brace. Referring to FIG. 3, brace 32 in the form of a turnbuckle is attached to a bracket 33 precast into the crown of span 18. The other end of the brace 32 is connected to a bracket 35 precast into a side face of the facia section 30. Facia 26 is similarly connected to the span 23 by a similar brace 34. Except for the bracket 33 on span 18 and a similar bracket on span 23, the spans are identical.

The spans are coupled to each other and to the facia 24, 26 at a plurality of locations by parallel rods 36. The rods 36 are tension tie rods having a length greater than the combined width of the spans so as to have exposed end portions. Each of the facia 24, 26 has a recess on its outer surface within which a nut and washer may be attached to each exposed end portion of the rods 36. Thereafter, the recess is filled with cementitous or bituminous mortar such as non-shrink grout 38. Grout 38 appears at four different locations in FIG. 1 and corresponds to the location of four rods 36. Depending upon the size of the bridge 10, a greater or lesser number of tie rods 36 may be utilized. The bridge 10 as illustrated is designed to have a span of 46 feet with the crown being approximately 10½ feet off the horizontal while using precast spans 18–23 which are approximately 10 inches thick.

As shown more clearly in FIG. 5, the juxtaposed side faces of adjacent spans 18 and 19 have parallel vertically disposed surfaces 40, 42 respectively. Surfaces 42, 44 then diverge outwardly and then converge upwardly and inwardly as indicated at 44 and 46. Between the parallel surfaces 40, 42 there is provided caulking 50. Between the converging surfaces 44, 46 there is provided mortar which is preferably a non-shrink grout 48. See FIG. 3.

Referring to FIG. 4, the ends of the spans are supported by a cast foundation 52. Foundation 52 preferably has a sloping surface 54 at an angle of approximately 45° with the horizontal. The ends of the spans are supported by steel shims 56 which are concealed by mortar 58 such as non-shrink grout.

METHOD OF INSTALLATION

The foundatons 52 are cast on opposite sides of the brook, creek, culvert or the like to be spanned by the bridge 10. After the concrete foundations 52 have been cured, the spans and facia are delivered to the site by a truck. The central span or spans are lifted by a crane and positioned so that their free ends are supported by the foundaton with steel shims 56 being utilized to obtain the proper elevation desired. Thereafter, the next adjacent spans are similarly positioned with caulking being applied between adjacent spans. Manipulation of the shims 56 will enable the tensioning rod holes in the spans to be aligned with one another. The facia sections are separately suspended and the tensioning rods 36 are extended there-through and through each set of aligned holes in the spans 18–23. Rods 36 may be a single member or a plurality of helically wound members so as to be a cable. After the nuts have been tightened on the tensioning rods 36, the grout 38 is applied. Also, grout 48 is applied between adjacent spans. The braces 32, 34 are attached to the associated brackets on the outside spans and facia sections.

Thereafter, selected fill 60 may be backfilled and compacted to overlie the precast spans. Crushed stone 62 may be applied over the dirt 60. Thereafter, a paved surface 64 may be applied so as to be flush with or slightly below the horizontally disposed top surface of the facia, 24, 26. See FIG. 3. Thereafter, optional features such as fence 12 or wings 14, 16 may be positioned and attached in a conventional manner.

The geometry of a typical span is shown in FIG. 6 and a typical load curve is shown in FIG. 7. The arch curve in FIG. 6 is defined by formulas:

$$t = \ln(r + \sqrt{r - 1}) \quad (1)$$

$$y = \frac{h}{(r-1)}\left(\cosh\left(\frac{2tx}{1}\right) - 1\right) \quad (2)$$

wherein r equals any number from 1.01 to 100; ln is the natural logarithm; cosh is the hyperbolic cosine; and x is a distance from 0 to 1/2.

Equations (1) and (2) are derived from a load condition shown in FIG. 7 wherein:

$$W = Wc\left(1 + \left(\frac{r-1}{h}\right) y\right) \quad (3)$$

$$We = rWc \quad (4)$$

wherein y equals the distance from zero to Wc. Equation (3) represents the load curve from which are derived equations (1) and (2). The pressure curve is identical to the arch curve, thus producing no moments for the loading as per equation (3) and with an arch having the geometry expressed by equations (1) and (2).

The shape of the overfilled arch is determined from statics so as to make the center line of the arch coincide with the pressure curve for the dead load. Hence, no moments exist apart from the moments induced by secondary effects such as arch shortening, thermal effects, settling, or moments due to partial span loading. This procedure reduces the material required for the arch structure, reduces construction costs, and/or enable the use of an overfilled arches as compared with other methods of construction.

The present invention enables the precast spans and the facia to be erected and attached to one another in a single day. In addition to forming part of the structure of the bridge, and providing a decorative appearance, the facia also are an integral part of the bridge in connection with acting as a retainer for the fill 60 and stone 62. Thus, there is disclosed herein a simple and practical design for a precast concrete bridge which may be rapidly assembled with minimal skilled labor.

The present invention may be embodied in other specific forms without departing from the spirit or essential attributes thereof and, accordingly, reference should be made to the appended claims, rather than to the foregoing specification, as indicating the scope of the invention.

I claim:

1. A bridge comprising a plurality of precast arcuate spans of reinforced concrete, said spans having arcuate top and bottom surfaces, said surfaces being uniformly spaced throughout a length of each said span, said spans disposed side by side between facia of reinforced concrete, said facia projecting upwardly to an elevation above the elevation of the crown of said spans, and a plurality of elongated rods or cables joining said spans to each other and to said facia.

2. A bridge in accordance with claim 1 wherein juxtaposed side faces of adjacent spans have upwardly converging surfaces filled with a non-shrink grout.

3. A bridge in accordance with claim 1 including reinforcement braces extending from the upper surface of the end spans to the inner surfaces of said facia.

4. A bridge in accordance with claim 1 wherein the facia at, each side of the bridge is comprised of two sections with at least two of said rods or cables extending through each facia section.

5. A bridge in accordance with claim 1 wherein said facia have an upper surface which at least in part is horizontally disposed and a lower surface which is arcuate, the arcuate surfaces on said facia matching the arcuate bottom surfaces on said spans.

6. A bridge in accordance with claim 1 including a concrete foundation at each end of said spans, each foundation having a surface at an angle that is about 45° to the horizontal for supporting the ends of the spans, and metal shims between the ends of the spans and said foundation angled surfaces.

7. A bridge comprising a plurality of precast arcuate spans of reinforced concrete, said spans having arcuate top and bottom surfaces, said surfaces being uniformly spaced throughout a length of each of said span, said spans disposed side by side between facia of reinforce concrete, said facia projecting upwardly to an elevation above the elevation of the crown of said spans, juxtaposed side faces of adjacent spans have upwardly converging surfaces filled with a non-shrink grout, said facia have an upper surface which at least in part is horizontally disposed and a lower surface which is arcuate, the arcuate surfaces on said facia being coextensive with the arcuate bottom surfaces on said spans, and a plurality of elongated rods or cables joining said spans to each other and to said facia, each span being precast with transvers holes for receiving said rods.

8. A bridge in accordance with claim 7 including reinforcement braces extending from the upper surface of the end spans to the inner surfaces of said facia.

9. A bridge in accordance with claim 7 wherein the facia at each side of the bridge is comprised of two sections with at least two of said rods or cables extending through each facia section.

10. A bridge in accordance with claim 7 including a concrete foundation at each end of said spans, each foundation having a surface at an angle that is about 45° to the horizontal for supporting the ends of the spans, compacted fill over said spans and confined by said facia, and metal shims between the ends of the spans and said foundation angled surfaces.

11. A bridge comprising a plurality of arcuate spans of uniform thickness throughout a length of each span and disposed side by side said span having arcuate top and bottom surfaces, said spans being precast reinforced concrete, each span having a plurality of transverse holes, each hole being aligned with a hole in an adjacent span to form a set of aligned holes, a metal rod extending through each set of aligned holes, each rod being longer than the combined width of said spans so as to have exposed end portions, facia of reinforced precast concrete, each facia being secured to the exposed end portions of said rods on opposite sides of the bridge, each facia having an arcuate bottom surface which is parallel to the bottom surface of said spans, compacted fill over said spans, and means on each side of the bridge for confining said fill.

12. A bridge comprising a plurality of arcuate spans of uniform thickness throughout a length of each span and disposed side by side, said spans having arcuate top and bottom surfaces, said spans being precast reinforced concrete, each span having a plurality of transverse holes, each hole being aligned with a hole in an adjacent span to form a set of aligned holes, a metal member extending through each set of aligned holes, each metal member being longer than the combined width of said spans, means on each end of each metal member for securing said spans therebetween, juxtaposed side faces of adjacent spans have upwardly converging surfaces adjacent the upper surface of said span and generally parallel vertical surfaces adjacent the lower surface of said spans, mortar between said converging surface and caulking between said generally parallel vertical surfaces.

* * * * *